United States Patent [19]

Carter et al.

[11] Patent Number: 4,625,786

[45] Date of Patent: Dec. 2, 1986

[54] INSULATED WINDOW SHADE ASSEMBLY

[75] Inventors: Neil A. Carter, 510 Galisteo St., Santa Fe, N. Mex. 87501; Armand G. Winfield, Santa Fe, N. Mex.

[73] Assignee: Neil A. Carter, Santa Fe, N. Mex.

[21] Appl. No.: 678,473

[22] Filed: Dec. 5, 1984

[51] Int. Cl.[4] ..... A47H 5/00

[52] U.S. Cl. ..... 160/84 R; 160/268 R

[58] Field of Search ..... 160/84 R, 268 R, 268 S, 160/273 R, 266, 120

[56] References Cited

U.S. PATENT DOCUMENTS

| | | | |
|---|---|---|---|
| 1,827,718 | 10/1931 | Whitney | 160/84 R |
| 4,019,554 | 4/1977 | Rasmussen | 160/84 R |
| 4,307,768 | 12/1981 | Anderson | 160/84 R |
| 4,347,887 | 9/1982 | Brown | 160/84 R X |
| 4,388,354 | 6/1983 | Suominen | 428/188 X |
| 4,418,739 | 12/1983 | Woolnough et al. | 160/120 |
| 4,450,027 | 5/1984 | Colson | 428/188 X |

*Primary Examiner*—J. Franklin Foss
*Assistant Examiner*—David M. Purol
*Attorney, Agent, or Firm*—William A. Eklund

[57] ABSTRACT

An insulated window shade assembly includes a pleated, two-ply window shade and two cooperable guide rails which are adapted for attachment to the side walls of a window casing. The shade consists of two pleated plys, which in the preferred embodiment are interconnected by means of draw strings which pass through the pleats. The edges of the pleated plys are shaped so that the unfolding of the pleats as the shade is lowered results in the edges forming an air-tight seal with the guide rails when the shade is fully lowered. As the shade is raised the edges of the pleated plys partially draw away from the guide rails to as to facilitate raising and lowering of the shade.

7 Claims, 8 Drawing Figures

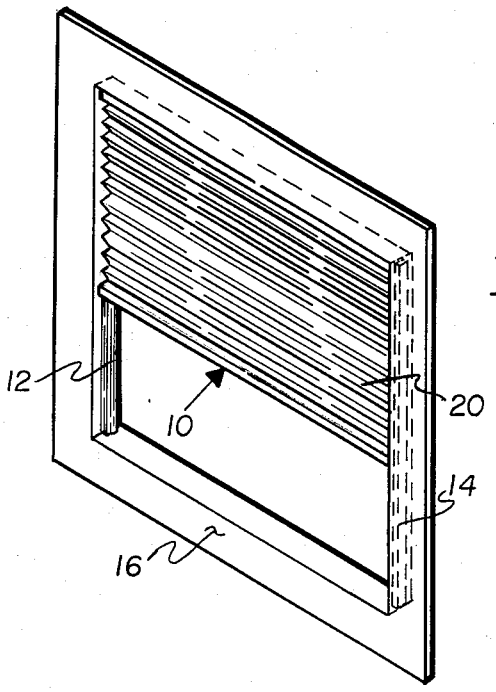
FIG. 1.
FIG. 2.
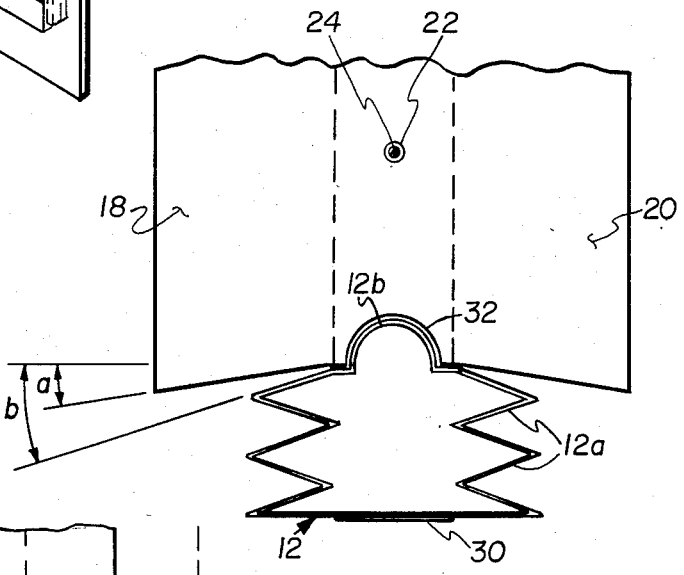
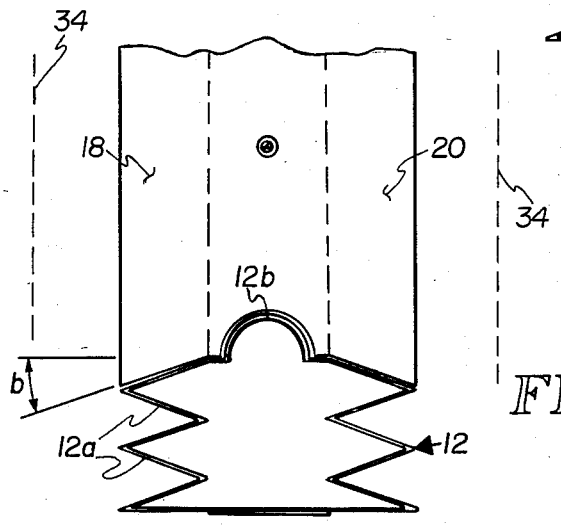
FIG. 3.

INSULATED WINDOW SHADE ASSEMBLY

BACKGROUND OF THE INVENTION

The invention disclosed herein is generally related to window shades, drapes and other window treatments. More particularly, this invention is related to insulated decorative window shades.

Interest in energy conservation in recent years has led to the development of various types of insulated window treatments, including, for example, quilted window shades, layered window shades, removable panel assemblies and others. Although these window treatments are generally effective for their intended purpose of insulating a window, they have met with only limited commercial success because, in most cases, they represent a compromise between aesthetic appearance and functional efficiency. For example, some of the previously available insulated shades are opaque, thus preventing their use during the day. Others are bulky and cumbersome in appearance. Some are awkward to open and close, or are difficult to store in a withdrawn position when not in use.

Accordingly, it is the object and purpose of the present invention to provide an improved insulated window shade assembly.

More particularly, it is an object of the present invention to provide an insulated window shade which can be raised to a compact and unobtrusive position when not in use, and which can be readily raised and lowered.

It is another object to provide an insulated window shade which can be fabricated in transparent, translucent or opaque embodiments.

It is yet another object to provide an insulated window shade assembly which includes means for providing an air-tight seal between the window shade and an adjacent window casing.

SUMMARY OF THE INVENTION

In accordance with the present invention, there is provided an insulated window shade assembly which includes a two-ply, insulated window shade and a pair of cooperable guide rails which are adapted to be attached to the sides of a window casing. The shade includes first and second pleated plys, each of which has multiple horizontal pleats formed by alternating inside folds and outside folds formed in the plys. There is further included means connecting the plys so as to maintain a uniform spacing between the plys while also permitting free folding of the plys along the pleats, whereby the shade can be raised upwardly to a compact raised position in which the plys are fully folded, and lowered downwardly to a lowered position in which the pleats are partially unfolded. Further, each of the plys has side edges which define the side edges of the shade and which are cut at an angle with respect to a vertical plane extending orgthogonally with respect to the plane of the shade. The edges of the pleated plys are cut so as to fit in a sealing relationship against the guide rails when the shade is in the lowered position, yet also partially draw away from the guide rails as the shade is raised, as a consequence of the folding motion of the pleats as the shade is raised, so as to thereby facilitate raising and lowering of the shade.

The two plys may consist of various suitable woven or unwoven, natural or synthetic materials, or a combination thereof, or a metallized polymeric sheet. In the preferred embodiment the plys consist of an exterior ply formed of a metallized polymeric sheet, and an interior ply formed of a woven material. The plys are interleaved with one another and are connected by draw strings which pass through aligned holes located adjacent to the inside folds of the plys.

These and other aspects of the present invention are more fully set forth in the accompanying drawings and in the following detailed description of the invention.

BRIEF DESCRIPTION OF THE DRAWINGS

The accompanying drawings are incorporated in and form a part of the specification. In the drawings:

FIG. 1 is a pictorial view of the preferred embodiment of the shade assembly of the present invention, as installed in a window casing;

FIG. 2 is a top view of one of the guide rails and a portion of the window shade in the raised position;

FIG. 3 is a top view of one of the guide rails and a portion of the window shade as in FIG. 2, but with the shade in the lowered position;

DETAILED DESCRIPTION OF THE INVENTION

Figure 4:
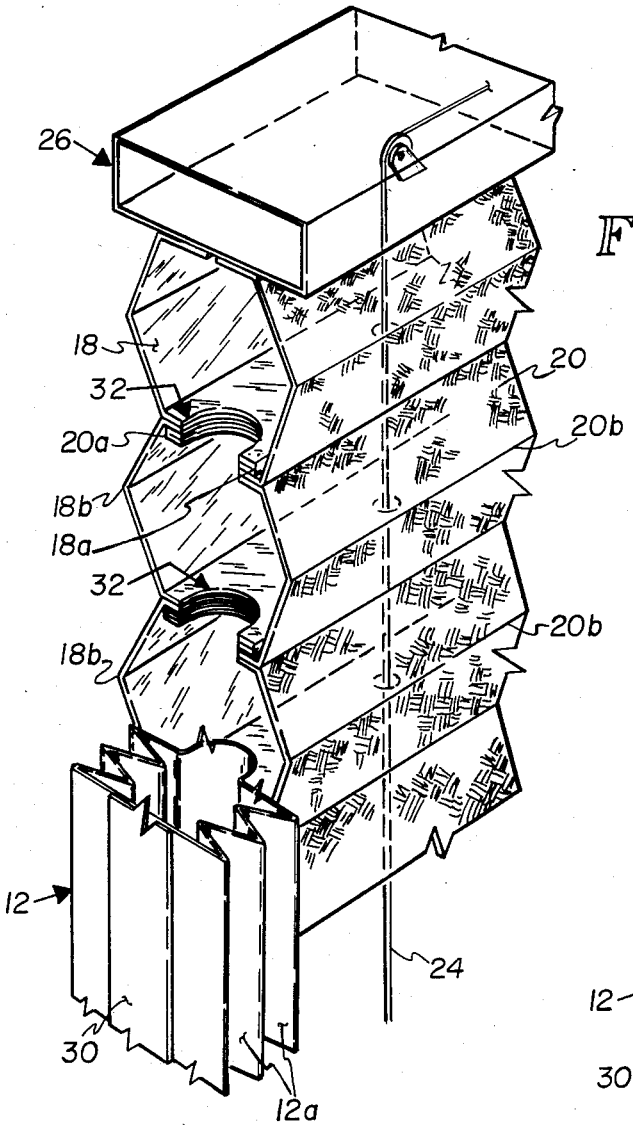
FIG. 4 is an isometric view of the window shade and one of the guide rails in partial cross section.

Referring to FIG. 1, the preferred embodiment of the present invention includes generally a pleated, two-ply window shade 10 and cooperable guide rails 12 and 14. The guide rails 12 and 14 are attached to and extend along the inside walls of a conventional window casing 16. The shade 10 may be raised to a compact retracted position at the top of the casing 16, as shown in end view in FIG. 6. When lowered, the side edges of the window shade 10 form air-tight seals with the guide rails 12 and 14, in a manner discussed in detail below, so as to minimize heat loss by convection of air around the edges of the window shade. The guide rails are substantially identical and will be described below only be reference to the left-hand guide rail 12 shown in FIG. 1. Referring particularly to FIGS. 4, 7 and 8, the shade 10 includes an exterior ply 18 and an interior ply 20. The exterior ply 18 is preferably formed of an aluminized polyester film having a thickness of between approximately 1 and 3 thousandths of an inch, and most preferably between 1 and 2 thousandths of an inch. One relatively well-known such film is commercially available under the trademark "Mylar". The film preferably includes an aluminum layer of thickness sufficient to allow approximately 62% light transmission.

The interior ply 20 may consist of any suitable woven or unwoven natural or polymeric material, or a combination thereof, or a metallized polymeric sheet. In the preferred embodiment the interior ply 20 consists of a woven polyester fabric and may be of a commercially available wide-weave construction having a metallized surface. In the preferred arrangement just described, both plys 18 and 20 of the shade 10 have light-reflective metallized surfaces which operate to provide a stylish, attractive insulated shade construction that is translucent and reflective.

The plys 18 and 20 are each pleated so that the shade may be raised and lowered by expansion or contraction of the pleated plys. For purposes of the following description, the folds in the plys which give rise to the pleated construction will be defined as inside folds 18*a* and 20*a* and outside folds 18*b* and 20*b* (FIG. 7, for example), with these terms referring to the positions of the folds relative to the internal construction of the shade 10 and not to the exterior or interior sides of the shade. That is, for example, the inside folds 18*a* of the exterior ply 18 are those folds which face the interior ply 20, and the folds 20*a* of ply 20 are likewise those folds which are closest to and face the ply 18.

The ply 18 is glued to itself along narrow strips along the outside of each inside fold 18*a*, so as to form horizontally extending tabs 18*c*, shown best in detail in FIG. 8. Ply 20 is likewise glued to itself along narrow strips adjacent each inside fold 20*a* to form horizontally extending tabs 20*c*. The tabs 18*c* and 20*c* are interleaved with and overlap one another. Holes 22 are punched in the tabs, through which there is passed a draw string 24 which is used to raise and lower the shade. The string 24 passing through the holes 22 also operates to keep the tabs interleaved and overlapped with one another, thereby effectively connecting the two plys 18 and 20 so that the pleated portions of the plys are maintained at a constant spacing from one another. The shade includes at least two such draw strings, one on each side of the shade, although only the one string 24 is illustrated in the drawings.

Figure 6:
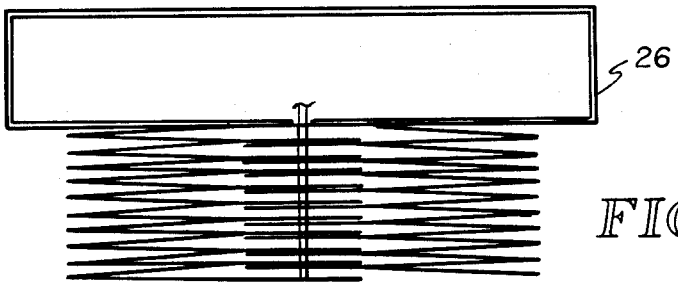
FIG. 6 is a side view of the window shade in the raised position.
Figure 7:
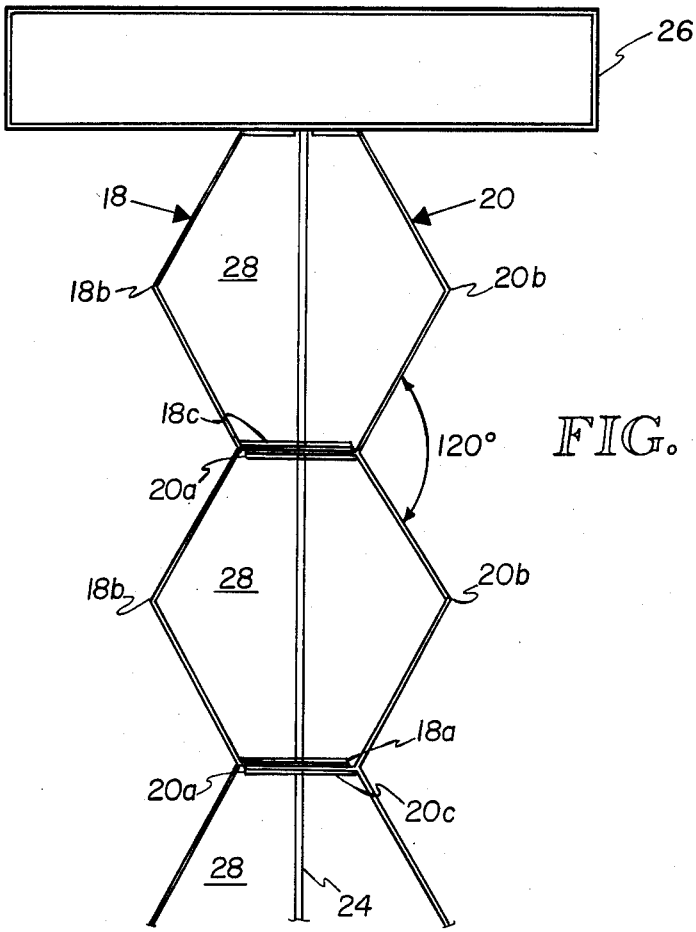
FIG. 7 is a side view of the window shade in the lowered position.
Figure 8:
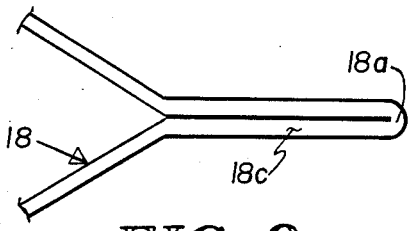
FIG. 8 is an enlarged cross-section of one pleat of the exterior ply of the window shade, which is identical to the construction of the interior pleats.

It will be seen from FIGS. 6 and 7 that the shade 10 can be raised to the top of the window casing, with both plys 18 and 20 being fully folded into a compact retracted position. In this regard, the shade is suspended from a support fixture 26 which may include any suitable arrangement of strings and pulleys to effect raising and lowering of the shade. When in the lowered position the pleated plys 18 and 20 and their respective tabs 18*c* and 20*c* form partially closed air cells 28 (FIG. 7) which enhance the insulating characteristics of the shade by minimizing convection between the interior and exterior plys.

Figure 5:
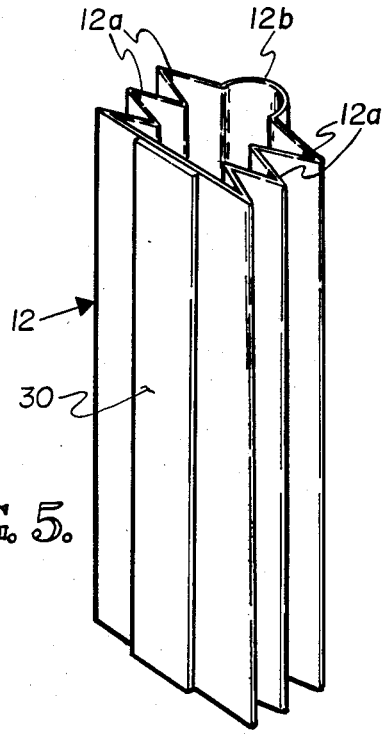
FIG. 5 is an isometric view of one of the guide rails.

The guide rails 12 and 14 may be formed of suitable engineering plastics such as polyvinyl chloride, acetal, nylon or other similar materials. In the illustrated preferred embodiment the guide rails 12 and 14 are formed of extruded, unfilled, rigid polyvinyl chloride, which is a preferred material because of its high gloss and high slip characteristics. The illustrative rail 12 shown in FIG. 5 is formed with an expansive bellows arrangement, including integral bellows elements 12*a*, which enables the rail to maintain sliding contact with the edge of the window shade. The rail includes a hemicylindrical guide 12*b* which engages the edge of the window shade in a manner described further below. The rail 12 is affixed to the window casing by means of a double-sided adhesive strip 30.

The edges of the window shade 10 are cut in such a manner that they are interlocked with and form an airtight seal with the rails 12 and 14 when the shade is lowered, yet draw away from the rails when the shade is raised so as to facilitate raising and lowering of the shade. More particularly, and referring to FIGS. 2 and 3, the side edges of those portions of the plys which form the tabs 18*c* and 20*c* are provided with semicircular cuts 32 (FIGS. 2, 3 and 4) which are sized to snugly engage the guide 12*b* of the rail 12. Additionally, those portions of the edges of the plys which are outside the central tabs 18*c* and 20*c* are cut at an angle such that, when the plys are in their fully folded positions as shown in FIGS. 2 and 6, the the edges of the pleated portions of the plys 18 and 20 assume an angle a with respect to that imaginary plane which is orthogonal to the plane of the window shade and which is also parallel to the edge of the shade and the longitudinal axes of the guide rails. When the shade is lowered to the position shown in FIGS. 3 and 7, wherein the angle between the individual adjacent plys of the shade is approximately 120° (FIG. 7), the edges of the plys 18 and 20 assume a greater angle, b, which is equal to the angle of the outermost bellows elements 12*a* of the guide rail. As a consequence the edges of the plys rest flush against the bellows elements 12*a* to form an air-tight seal. In the illustrated embodiment, the angle a is one-half the angle b. Further, it will be seen from, FIGS. 2, 3, 6 and 7 that as the shade is lowered the plys 18 and 20 are effectively brought closer together, so that when the shade is fully lowered the thickness of the shade is equal to the thickness of the guide rail 12, as best shown in FIG. 3, thereby forming an attractive, air-tight structure which is of uniform thickness across the entire width of the window casing. In FIG. 3 the overall thickness of the shade in the lowered position is compared with the overall thickness in the raised position by means of dashed lines 34, which indicate the overall thickness of the shade in the raised position of FIG. 2.

For optimum operation of the shade as described above, the upper edges of the plys 18 and 20 should be attached to the support fixture 26 such that the upper edges are spaced apart by a distance which is approximatley equal to the width of the tabs 18*c* and 20*c*, as illustrated best in FIGS. 4 and 7. This ensures that the shade, when lowered, assumes the position shown in FIG. 7, with the lowered shade being of uniform overall thickness from top to bottom.

The foregoing detailed description and the illustrations of the preferred embodiment of the present invention are presented for the purpose of enabling one of ordinary skill in the art to make and use the invention. The detailed description and the illustrations are not intended to limit the invention, and various modifications, alterations and substitutions may be made without departing from the essential invention. Accordingly, the scope of the invention is defined by the following claims.

What is claimed is:

1. An insulated window shade assembly comprising:

a window shade including first and second pleated plys, each of said plys having multiple horizontal pleats formed by alternating inside folds and outside folds formed in said plys, means connecting said plys so as to maintain a uniform spacing between said plys while also permitting free folding of said plys along said pleats, whereby said shade can be raised upwardly to a compact raised position in which said plys are fully folded and lowered downwardly to a lowered position in which said pleats are partially unfolded, each of said plys having side edges which define the side edges of said window shade and which are cut at an angle with respect to a vertical plane extending orthogonally with respect to the plane of the shade, and a pair of guide rails for attachment to a window casing, each of said guide rails including angled surfaces which abut and conform with said side edges of said pleated plys when said shade is in said lowered position, said side edges of said pleated plys being cut at an angle which is approximately one half the angle of said angled surfaces of said guide rails, said angle being taken with respect to a vertical plane oriented orthogonally with respect to the plane of the shade, and wherein said pleats of said plys extend at an angle of approximately 120° with respect to one another when said shade is in said lowered position, whereby said side edges of said plys flushly abut said surfaces of said guide rail in a sealing relationship when said shade is in said lowered position, and wherein said side edges of said pleated plys partially draw away from said guide rails to reduce friction as said shade is raised due to folding motion of said pleats.

2. The window shade assembly defined in claim 1 wherein each of said plys is adhered to itself along outside strips adjacent each of said inside folds, so as to thereby form horizontally extending tabs, and wherein said plys are connected to one another by means of at least one draw string extending through aligned holes in said tabs.

3. The window shade assembly defined in claim 2 wherein each of said horizontally extending tabs in said plys includes semicircular cuts in the side edges of said tabs, and wherein said guide rails each include semicircular guides which slidably engage said plys by fitting cooperably in said semicircular cuts.

4. The window shade assembly defined in claim 1 wherein said guide rails include a bellows construction so as to be resiliently urged against said side edges of said shade.

5. The window shade assembly defined in claim 3 wherein said guide rails include a bellows construction so as to be resiliently urged against said side edges of said shade, and wherein said guide rails include angled bellows elements which flushly abut said side edges of said plys when said shade is in said lowered position.

6. The window shade assembly defined in claim 5 wherein said first ply is an exterior ply formed of a metallized polyester film and wherein said second ply is an interior ply formed of a woven polyester fabric.

7. The window shade assembly defined in claim 6 wherein said guide rails are formed of extruded unfilled rigid polyvinyl chloride.

* * * * *